US007962075B2

(12) United States Patent
Ji et al.

(10) Patent No.: US 7,962,075 B2
(45) Date of Patent: Jun. 14, 2011

(54) NYLON12-FIBER-IMPLANTED CONDUCTIVE ROLLER, DEVELOPING UNIT HAVING THE SAME, AND IMAGE FORMING APPARATUS HAVING THE SAME

(75) Inventors: Young-Phil Ji, Suwon-Si (KR); Mi-Na You, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 21 days.

(21) Appl. No.: 12/535,327

(22) Filed: Aug. 4, 2009

(65) Prior Publication Data

US 2010/0119266 A1 May 13, 2010

(30) Foreign Application Priority Data

Nov. 12, 2008 (KR) ..... 10-2008-0112407

(51) Int. Cl.
*G03G 15/08* (2006.01)

(52) U.S. Cl. ..... 399/281; 399/286

(58) Field of Classification Search ..... 399/281, 399/286, 279, 174, 175, 176, 100, 303, 313, 399/315; 492/18, 50, 55
See application file for complete search history.

(56) References Cited

U.S. PATENT DOCUMENTS

| | | | | |
|---|---|---|---|---|
| 4,319,831 | A * | 3/1982 | Matsui et al. | 399/353 |
| 5,602,712 | A * | 2/1997 | Daifuku et al. | 399/176 X |
| 6,337,966 | B1 * | 1/2002 | Yamamoto | 399/281 |
| 2003/0210931 | A1 * | 11/2003 | Haraguchi et al. | 399/281 |
| 2004/0086303 | A1 * | 5/2004 | Ohkuwa et al. | 399/281 |
| 2007/0098459 | A1 * | 5/2007 | Endo et al. | 399/281 |
| 2007/0104504 | A1 * | 5/2007 | Terai et al. | 399/100 |
| 2008/0187360 | A1 * | 8/2008 | Fujita et al. | 399/176 |
| 2009/0016769 | A1 * | 1/2009 | Hatakeyama et al. | 399/107 |

FOREIGN PATENT DOCUMENTS

| | | |
|---|---|---|
| KR | 10-2004-0095206 | 11/2004 |
| KR | 10-2008-0038804 | 5/2008 |

OTHER PUBLICATIONS

English language abstract of KR 10-2008-0038804, published May 7, 2008.
English language abstract of KR 10-2004-0095206, published Nov. 12, 2004.

* cited by examiner

*Primary Examiner* — Sophia S Chen
(74) *Attorney, Agent, or Firm* — Stanzione & Kim, LLP

(57) ABSTRACT

Disclosed is a toner supply apparatus that can be employed in an image forming apparatus to supply toner. The toner supply apparatus can include an electrically conductive body, on the surface of which multiple fibers is arranged. The fibers may include nylon 12 fibers containing a conductive material, such as, for example, carbon black.

23 Claims, 7 Drawing Sheets

<Test for resistance upon aging>

<Test for the strength of color of image and toner consumption under condition HH>

NYLON12-FIBER-IMPLANTED CONDUCTIVE ROLLER, DEVELOPING UNIT HAVING THE SAME, AND IMAGE FORMING APPARATUS HAVING THE SAME

CROSS-REFERENCE TO RELATED APPLICATIONS

This application claims the benefit under 35 U.S.C. §119 (a) of Korean Patent Application No. 10-2008-112407, filed Nov. 12, 2008, in the Korean Intellectual Property Office, the entire disclosure of which is hereby incorporated by reference.

TECHNICAL FIELD

The present disclosure generally relates to a conductive roller, a developing unit having the same, and an image forming apparatus having the same. More particularly, the present disclosure relates to a nylon 12-fiber-implanted conductive roller, a developing unit having the same, and an image forming apparatus having the same.

BACKGROUND OF RELATED ART

In general, image forming apparatuses, such as, for example, printers, copiers, and facsimile machines, print documents using an electro-photographic developing method in which an electrostatic latent image on an image bearing unit is developed to produce a toner image that is then transferred to a printing medium.

To print documents using the electro-photographic developing method, an image forming apparatus cam include multiple rollers having diverse functions. Among such rollers are, for example, conductive rollers that receive an electrical power, an example of which may be a toner supply roller.

The toner supply roller is a roller configured to supply toner to a developing roller positioned opposite the toner supply roller. To transfer the toner to the developing roller using electrical attraction as well as contact friction, the toner supply roller can receive an electrical power to generate an electric potential difference with the developing roller.

The toner supply roller can be generally formed in one of two types: a sponge-type supply roller or a fiber-type supply roller. A sponge-type supply roller can be made of a foaming rubber such as silicon or urethane, for example. A fiber-type supply roller can be made by implanting multiple fibers on the external surface of the toner supply roller.

For a sponge-type toner supply roller, having uniformly formed foaming cells on the surface of the sponge-type toner supply roller is important to uniformly supply a toner onto the surface of the developing roller. Because it is not easy to effectively manage the foaming rate, manufacturing toner supply rollers that have a uniform electrical resistance, hardness of the surface, and the number of cells can be difficult to achieve.

For a fiber-type toner supply roller, acrylic fibers or nylon 6 fibers are generally used. To improve upon the performance that can be achieved with sponge-type toner supply rollers, there has been a growing interest in research and development of uniform density of fibers for fiber-type toner supply rollers made of acrylic fibers or nylon 6 fibers.

Research and development effort for improving conductivity of the toner supply roller has not been performed with a similar effort. For example, rollers implanted with nylon 6 fibers can have the electrical resistance changed according to changing ambient conditions, such as changes in temperature and the humidity, for example, that can result in sudden increases in the electrical resistance.

When the electrical resistance of the toner supply roller cannot be maintained at a constant value, the supply of toner to the developing roller may be erratic, possibly resulting in a deterioration of the printing quality and/or an irregular amount of toner consumption.

Therefore, the stable conductivity of the toner supply roller and/or of other conductive rollers in the image forming apparatus is desirable.

SUMMARY OF THE DISCLOSURE

According to an aspect of the present disclosure, there is provided a toner supply apparatus for supplying toner in an image forming apparatus. The toner supply apparatus may include an electrically conductive body and a plurality of fibers disposed on a surface of the body, the plurality of fibers including nylon 12 fibers containing a conductive material.

The surfaces of the plurality of fibers may be coated with a conductive polymer.

The conductive polymer may be a compound having one of an aromatic heterocyclic structure and an aniline structure.

The plurality of fibers may have a volume resistivity that ranges from approximately $10^5$ ohms-per-centimeter (Ω/cm) to approximately $10^8$ Ω/cm.

The plurality of fibers may have a moisture absorption rate that is below approximately 1.2 percent (%) at a relative humidity of 65%, and below approximately 1.5% at a relative humidity of 95%.

The density of the plurality of fibers may range from approximately 18.5 items-per-millimeter (items/mm) to approximately 22.0 items/mm.

The length of each of the plurality of fibers may range from approximately 1.3 millimeters (mm) to approximately 1.7 mm.

The diameter of each of the plurality of fibers may range from approximately 25 micrometers (μm) to approximately 40 μm.

The conductive material contained in the plurality of fibers may comprise carbon black. The content of the carbon black in the plurality of fibers may range from approximately 18 percent (%) to approximately 23%.

According to another aspect, an image forming apparatus may be provided to include a developing unit that may be configured to develop an electrostatic latent image using toner to form a visible toner image. The developing unit may include a rotational member. The rotational member may comprise an electrically conductive body and a plurality of fibers disposed on a surface of the body, the plurality of fibers including nylon 12 fibers containing a conductive material.

The rotational member may comprise a device selected from among a charging device configured to charge an image bearing body on surface of which the electrostatic latent image is formed, a cleaning device configured to remove foreign substances from a surface of the charging device and a discharging device configured to remove an electrical charge from a printing medium.

According to yet another aspect, a developing unit usable in an image forming apparatus to form a toner image may be provided to include a conductive member that comprises a body that is electrically conductive and a plurality of fibers disposed on a surface of the body, the plurality of fibers including nylon 12 fibers containing a conductive material.

The conductive member may comprise one of a charging device configured to charge an image bearing body configured to carry on a surface thereof an electrostatic latent image, a cleaning device configured to remove foreign substances from the charging device and a discharging device configured to remove an electrical charge from a printing medium.

The body may be made of a conductive metal in a substantially cylindrical shape, the conductive material comprising aluminum.

The conductive member may be configured to rotate in contact with a rotational body. The respective rotational speeds of the conductive member and the rotational body may be different from each other.

BRIEF DESCRIPTION OF THE DRAWINGS

Various features, and advantages of certain embodiments of the present disclosure will be more apparent from the following description taken in conjunction with the accompanying drawing, in which.

Throughout the drawings, the same drawing reference numerals are understood to refer to the same elements, features, and structures.

DETAILED DESCRIPTION OF SEVERAL EMBODIMENTS

The matters defined in the description such as a detailed construction and elements are provided to assist in a comprehensive understanding of several embodiments of the disclosure. Accordingly, those of ordinary skill in the art will recognize that various changes and modifications of the embodiments described herein can be made without departing from the scope and spirit of the disclosure. Moreover, descriptions of well-known functions and constructions may be omitted for clarity and conciseness.

Figure 1:
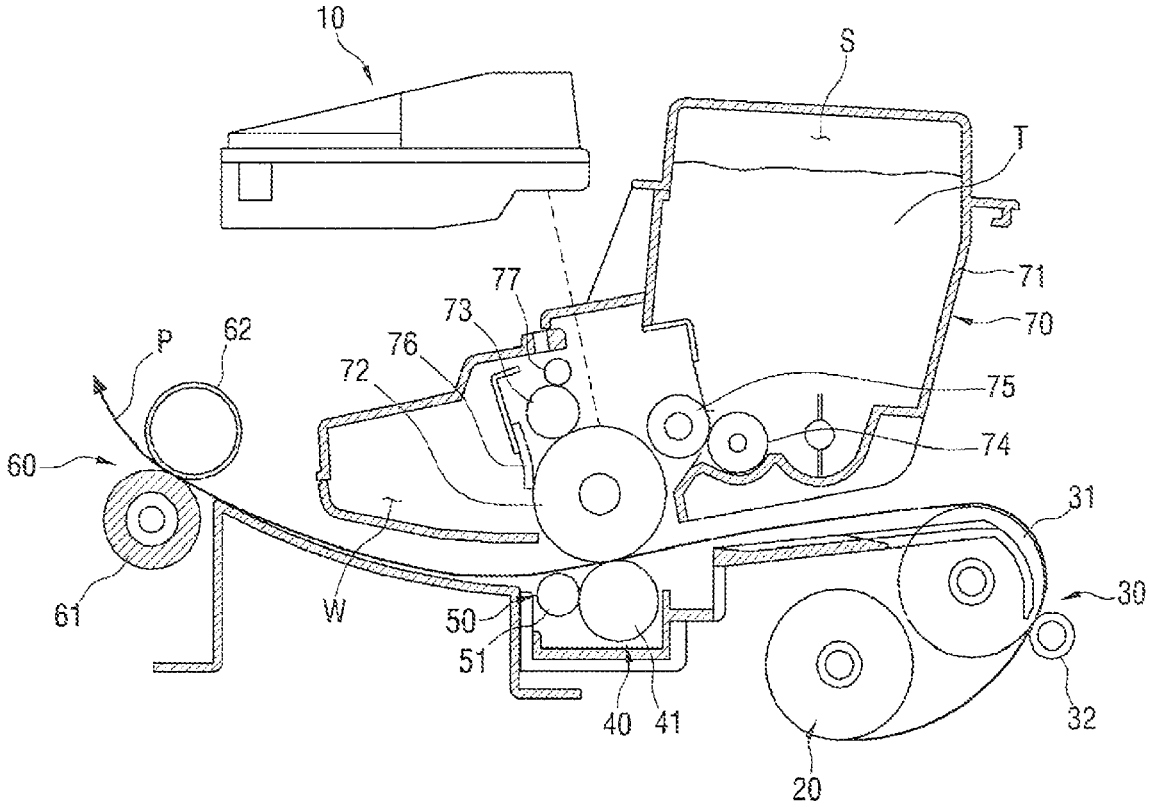
FIG. 1 is a schematic block diagram illustrating a configuration of an image forming apparatus according to an embodiment of the present disclosure.

FIG. 1 is a schematic block diagram illustrating a configuration of an image forming apparatus according to an embodiment of the present disclosure.

As illustrated in FIG. 1, the image forming apparatus can include a light exposing unit 10, a pickup unit 20, a transport unit 30, a transfer unit 40, a discharging unit 50, a fusing unit 60 and a developing unit 70.

The light exposing unit 10 can be disposed above the developing unit 70, and can be configured to expose a laser beam corresponding to printing data to an image bearing roller 72 in the developing unit 70 to form an electrostatic latent image on the image bearing roller 72.

The pickup unit 20 can be configured to pick up a printing medium placed on a printing medium supply unit (not shown) one at a time. The transport unit 30 can include transport rollers 31 and 32. Each of the transport rollers 31 and 32 can be configured to transport the printing medium picked up by the pickup unit 20 along a transport path P. In the embodiment illustrated in FIG. 1, the transport unit 30 is shown to only include the transport rollers 31 and 32. In other embodiments, however, the transport unit 30 can have additional transport rollers disposed along the transport path P.

The transfer unit 40 can include a transfer roller 41 that can be configured to rotate in contact with the image bearing roller 72. The transfer roller 41 can be configured to transfer a toner image on the image bearing roller 72 to the printing medium when the printing medium passes between the image bearing roller 72 and the transfer roller 41.

The discharging unit 50 can include a discharging roller 51 disposed adjacent to the transfer roller 41. The discharging roller 51 can be configured to receive electrical power such that the discharging roller 51 produces a potential with a polarity opposite to the polarity of electric charges that are left on the printing medium after the toner image is transferred, thereby drawing the printing medium and removing static electricity from the printing medium. As a result, a paper jam caused by the printing medium sticking to the image bearing roller 72 can be prevented and the transport of the printing medium need not be interrupted by static electricity on the printing medium.

The fusing unit 60 can include a heating roller 61 and a pressure roller 62, and can be configured to fix the transferred toner to the printing medium by applying heat and pressure to the printing medium passing through the heating roller 61 and the pressure roller 62.

The developing unit 70 can include a frame 71, the image bearing roller 72, a charging apparatus such as the charging roller 73, a toner supply apparatus such as a toner supply roller 74, a developing apparatus such as a developing roller 7, a waste toner cleaner 76 and a cleaning apparatus such as the cleaning roller 77.

The frame 71 can be configured to form an exterior of the developing unit 70, and can be configured to accommodate a toner storage space S configured to store a toner T and a waste toner storage space W configured to collect waste toner.

The image bearing roller 72 can be partially exposed outside the frame 71 such that the image bearing roller 72 can make contact with the transfer roller 41.

The charging roller 73 can be disposed opposite to or facing the image bearing roller 72 to charge the surface of the image bearing roller 72 at a certain electrical potential. Accordingly, the charging roller 73 can be configured to receive the electrical power needed to produce an appropriate charge on the surface the image bearing roller 72.

The toner supply roller 74 can be configured to supply toner stored in the toner storage space S to the developing roller 75 by using contact friction and/or electric attraction. Detailed description of the toner supply roller 74 is provided below.

The developing roller 75 can be configured to attach the toner supplied by the toner supply roller 74 to the image bearing roller 72 so that a toner image corresponding to an electrostatic latent image can be formed on the image bearing roller 72.

The waste toner cleaner 76 can be configured to remove waste toner left on the image bearing roller 72 after the toner image is transferred from the image bearing roller 72 to the printing medium.

The cleaning roller 77 can be configured to remove foreign substances, such as toner particles, paper powder and dust, for example, which can be attached to the discharging roller 73. The cleaning roller 77 can be conductive or nonconductive. In the embodiment described herein with respect to FIG. 1, the cleaning roller 77 is implemented as a conductive roller and can be configured to receive electrical power to electrically attract the foreign substances.

Figure 2:
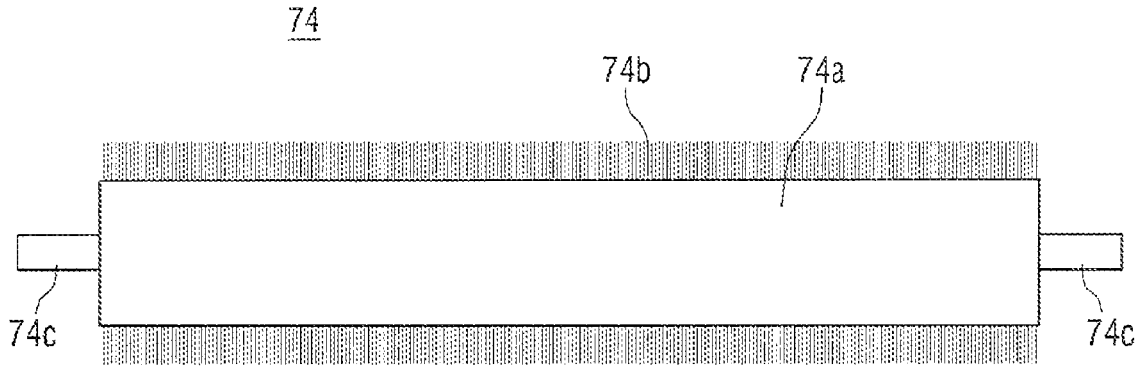
FIG. 2 is a schematic front view illustrating the toner supply roller provided in the image forming apparatus of FIG. 1.
Figure 3:
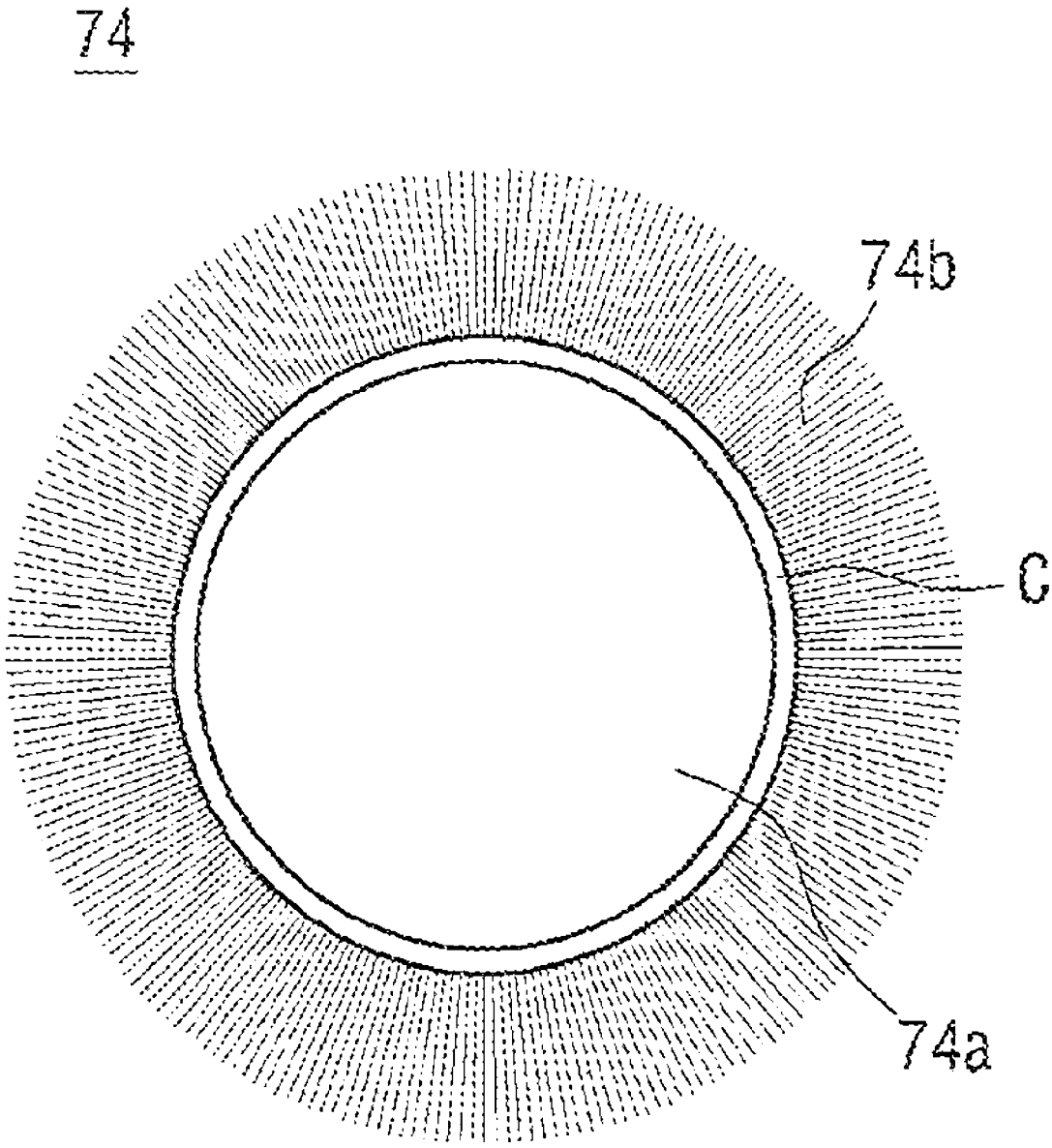
FIG. 3 is an enlarged cross section of the toner supply roller of FIG. 2.

The toner supply roller 74 is described below in greater detail with reference to FIGS. 2 and 3. FIG. 2 is a schematic front view illustrating the toner supply roller 74 that may be employed in the image forming apparatus of FIG. 1. FIG. 3 is an enlarged cross section of the toner supply roller 74 of FIG. 2.

Referring to FIGS. 2 and 3, the toner supply roller 74 can include a roller body 74*a* of a cylindrical shape, and a plurality of fibers 74*b* that are uniformly implanted on the circumferential surface of the roller body 74*a*.

The roller body 74*a* can be made of a metal having good conductivity such as stainless steel SUS303, stainless steel SUS304, carbon steel SUM22, or aluminum, for example, or a substance having conductivity and hardness that are similar to those of metal. In one embodiment, the roller body 74*a* can have a diameter of approximately 6 millimeters (mm) and a length of approximately 218 mm. A pair of supporting shafts 74*c* can be integrally formed at both ends of the roller body 74*a*.

Multiple fibers 74*b* can be formed on the surface of the roller body 74, and can be made of nylon 12 fibers that can contain carbon black as a conductive material. The carbon black content can range from about 18% to about 23%.

The nylon 12 fibers used as a main material of the fibers 74*b* can have low moisture absorption. Accordingly, although operating conditions such as the temperature or humidity can change, the conductivity of the fibers 74*b* can be maintained substantially stable. Typically, when the fibers in the roller body 74 absorb moisture, the electric resistance decreases. When the fibers 74*b* are made of nylon 12, however, the low moisture absorption of such fibers minimizes changes in the electrical resistance of the fibers from the absorption of moisture.

The surface of each fiber 74*b* can be coated with a conductive polymer. In one embodiment, the conductive polymer can be a compound having an aromatic heterocyclic structure or a compound having an aniline structure, for example. When the surface of the fibers 74*b* are coated with the conductive polymer, adhesion of the toner can be enhanced. Coating the fibers 74*b* with a conductive polymer can reduce the increase in the resistance of the fibers 74*b* that can occur over time due to friction or other causes during operation.

Below are described numerical values and/or physical properties associated with the fibers 74*b* so that the toner supply roller 74 can function smoothly. In, one or more embodiments associated with the present disclosure, the fibers 74*b* can be manufactured to satisfy some or all of the numerical values and/or physical properties described below.

The volume resistance of the fibers 74*b* can range from approximately $1\times10^5$ Ohms-per-centimeter (Ω/cm) to approximately $1\times10^8$ Ω/cm. When the volume resistance of the fibers 74*b* is high, there may be a greater attraction of the toner thereto because of the higher remaining electrical charge. As a result, the density of the color of an image can be low, resulting in an inferior image quality. When the volume resistance of the fibers 74*b* is low, however, a higher color density in the resulting image can be realized. In an embodiment of the present disclosure, the fibers 74*b* can have a volume resistance of approximately $1\times10^6$ Ω/cm, for example.

The moisture absorption rate of the fibers 74*b* can be below approximately 1.2% at a relative humidity of 65%, and below approximately 1.5% at a relative humidity of 95%, for example. A comparatively low moisture absorption rate of the fibers 74*b* can minimize the likelihood of the changes in the conductivity of the toner supply roller 74 based on changes in the ambient conditions such as the temperature or humidity.

The density of the fibers 74*b* can range from approximately 18.5 items/mm to approximately 22.0 items/mm. When the density of the fibers 74*b* is below approximately 18.5 items/mm, the electrical charge of the toner can be reduced, which reduces the amount of toner supplied, and which in turn may adversely impact the image duality. When the density of the fibers 74*b* is above approximately 22.0 items/mm, the surface of the toner supply roller 74 can become less flexible, resulting in the reduction of the mobility of the toner particles so that the toner particles between the developing roller 75 and the toner supply roller 74 can more readily detach, which in turn may also adversely impact the image quality. In an embodiment of the present disclosure, the fibers 74*b* can have a density ranging from approximately 19.5 items/mm to approximately 20.5 items/mm, for example.

The length of each fiber 74*b* can range from approximately 1.3 mm to approximately 1.7 mm. When the length of each fiber 74*b* is below approximately 1.3 mm, a portion of an image may be missing in a rotational cycle of the toner supply roller 74 because of a disproportional supply of toner. When the length of each fiber 74*b* is above approximately 1.7 mm, load torque between the developing roller 75 and the toner supply roller 74 can increase and the shading of an image can change in the rotational cycle of the toner supply roller 74. In an embodiment of the present disclosure, the fibers 74*b* can have a length of approximately 1.5 mm, for example.

The diameter of each fiber 74*b* can range from approximately 25 micrometers (μm) to approximately 40 μm. When the diameter of each fiber 74*b* is below approximately 25 μm, a toner reset function of the toner supply roller 74 can deteriorate, and an afterimage (e.g., a ghost effect) may be printed in a rotational cycle of the developing roller 75. When the diameter of each fiber 74*b* is above approximately 40 μm, the toner supply roller 74 can continuously wear away the surface of the developing roller 75 and a chafed mark can be formed on the surface of the developing roller 75 and chafed image (e.g., a filming effect) may be printed. In one embodiment of the present disclosure, the fibers 74*b* can have a diameter ranging from approximately 33 μm to approximately 38 μm, for example.

The toner supply roller 74 according to one or more embodiments of the present disclosure can be manufactured according to the following process. The fibers 74*b* can be implanted on the roller body 74*a* using an electrostatic implanting method. That is, a water-soluble acrylic bonding agent C (see FIG. 3) containing carbon black can be applied with a thickness of about 40 μm to the surface of the roller body 74*a*, and a voltage ranging from approximately 30,000 kilovolts (kV) to approximately 40,000 kV can be applied to the roller body 74*a*. The fibers 74*b* in a position to face the roller body 74*a* can be released and rapidly inlaid in the roller body 74*a* so that the fibers 74*b* can be implanted on the roller body 74*a*. The roller body 74*a* on which the fibers 74*b* are implanted can be primarily dried in a hot wind drying machine of at about 80° C. for approximately 15 minutes, and secondarily dried in a hot wind drying machine at about 110° C. for approximately 60 minutes.

Three different tests have been carried out to show the performance of the toner supply roller 74 according to embodiments of the present disclosure.

For the purpose of comparisons of the toner supply roller 74 according to embodiments of the present disclosure with conventional toner supply rollers, a conventional toner supply roller employing nylon 6 fibers is used as comparison example 1 while a conventional toner supply roller employing acrylic fibers is used as comparison example 2. The toner supply roller 74 can differ from the conventional toner supply rollers in comparison examples 1 and 2 in the numerical values and/or physical properties associated with the fibers, for example.

Figure 4:
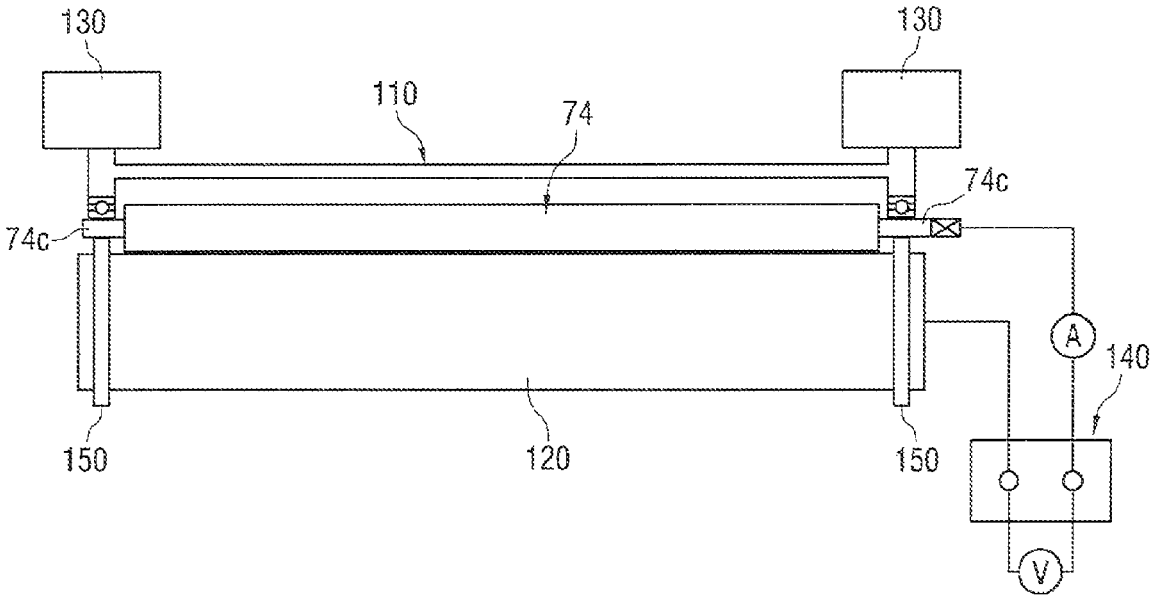
FIG. 4 is a schematic front view illustrating a resistance measuring jig used in the first and second tests.

The first and second tests can be performed with a resistance measuring device as illustrated in FIG. 4 to measure the electric resistance of the toner supply rollers. FIG. 4 is a schematic front view illustrating the resistance measuring device used in the first and second tests. A method for measuring the electric resistance using the resistance measuring device is briefly described below.

Referring to FIG. 4, the resistance measuring device can include a rotational supporting unit 110 configured to support a toner supply roller so that the toner supply roller can rotate, a brass cylinder 120 disposed opposite the toner supply roller and configured to rotate, a pair of pressing members 130 configured to press the rotational supporting unit 110 downwards and a resistance measuring unit 140 configured to measure the resistance of the toner supply roller. A pair of urethane rubber members 150 can be wound around the circumference of both ends of the brass cylinder unit 120, and can be configured to support the pair of supporting shafts of the toner supply roller upwards. The urethane rubber members 150 can be configured to maintain certain distance between the roller body of the toner supply roller and the brass cylinder, for example, a distance of approximately 0.3 mm.

An electrical current can be measured when the toner supply roller is mounted on the resistance measuring device as illustrated in FIG. 4 while the toner supply roller is rotated at approximately 23 revolutions-per-minute (rpm) with a voltage of approximately 100V is applied to the toner supply roller. The electrical resistance of the toner supply roller can be calculated based on the measured voltage and electrical current using Ohm's law. The electrical resistance of the toner supply roller measured using the resistance measuring device as described above can simulate the actual electrical resistance (i.e., the driving resistance) of the toner supply roller operating in an image forming apparatus.

In the first test, the toner supply roller 74 and the comparison examples 1 and 2 can be placed in an environment for 8 hours, and may be exposed to one of three conditions during that time a first condition LL having a temperature of about 10° C. and humidity of about 20%; a second condition NN having a temperature of about 23° C. and humidity of about 55%; and a third condition HH having a temperature of about 30° C. and humidity of about 80%. For each condition, the electrical resistance of the toner supply rollers can be measured using the aforementioned resistance measuring device.

Figure 5:
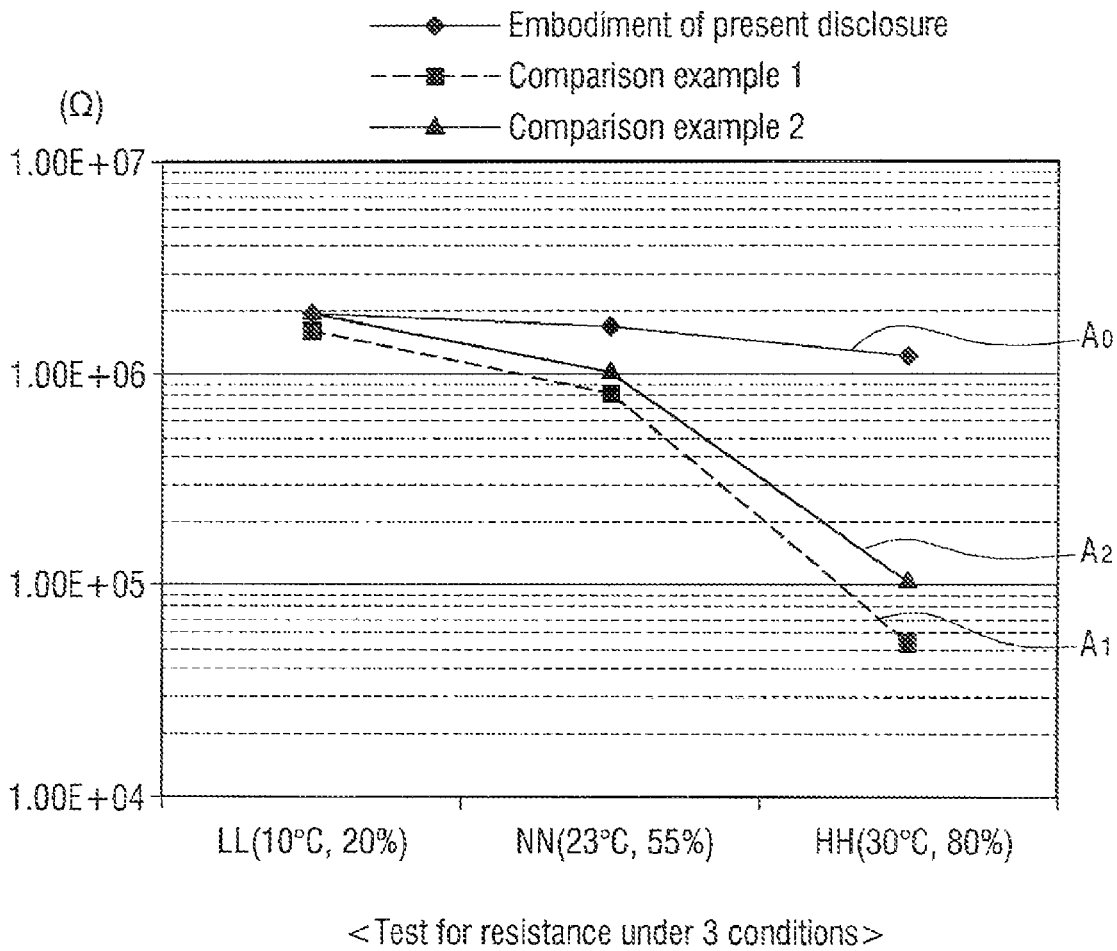
FIG. 5 is a graph illustrating data obtained from the first test.

The results of the first test are shown in Table 1, and are shown graphically in FIG. 5.

TABLE 1

| | Resistance of Condition LL (10° C., 20%) | Resistance of Condition NN (23° C., 55%) | Resistance of Condition HH (30° C., 80%) |
|---|---|---|---|
| Toner supply roller 74 | 1.92E+06 Ω | 1.70E+06 Ω | 1.21E+06 Ω |
| Comparison example 1 (nylon 6 fibers) | 1.62E+06 Ω | 8.24E+05 Ω | 5.41E+04 Ω |
| Comparison example 2 (acrylic fibers) | 1.98E+06 Ω | 1.02E+06 Ω | 1.04E+05 Ω |

As illustrated in Table 1, the electrical resistance of the toner supply roller 74 does not change substantially under the three conditions. In comparison example 1 and comparison example 2, however, it can be observed that the electrical resistance of the toner supply rollers can be reduced, especially under condition HH. This aspect is more clearly shown in FIG. 5. Referring to FIG. 5, graph $A_0$, which corresponds to the toner supply roller 74, is shown to be substantially horizontal and not changing significantly when exposed to different conditions, whereas graphs $A_1$ and $A_2$, which correspond to comparison examples 1 and 2, respectively, show that the electric resistance of the comparison examples is reduced when the comparison examples are exposed to condition HH.

The toner supply roller 74 can have a much lower change in the electrical resistance according to conditions such as the temperature or humidity than the toner supply rollers using acrylic fibers or nylon 6 fibers. These results show that the toner supply roller 74 can have a more stable electrical conductivity than conventional toner supply rollers when conditions such as the temperature or humidity vary.

The second test performed can be used to identify a change in the electrical resistance of the toner supply rollers over time. In the second test, after the toner supply rollers are exposed for 8 hours to condition NN, the toner supply rollers can be mounted on the resistance measuring device described above with respect to FIG. 4, and are aged continuously under condition NN. The electrical resistance of the toner supply rollers can be measured during the aging process. The resistance measuring unit 140 of the resistance measuring device can be configured to measure the electrical resistance of the toner supply rollers at different times during the aging process. In one example, measurements can be made at 0 minutes, 20 minutes, 40 minutes, 1 hour, and 24 hours. Other measurement sequences at times different from those times illustrated in the previous example can also be used. The second test can be performed for the toner supply roller 74 and the toner supply rollers of comparison examples 1 and 2.

Figure 6:
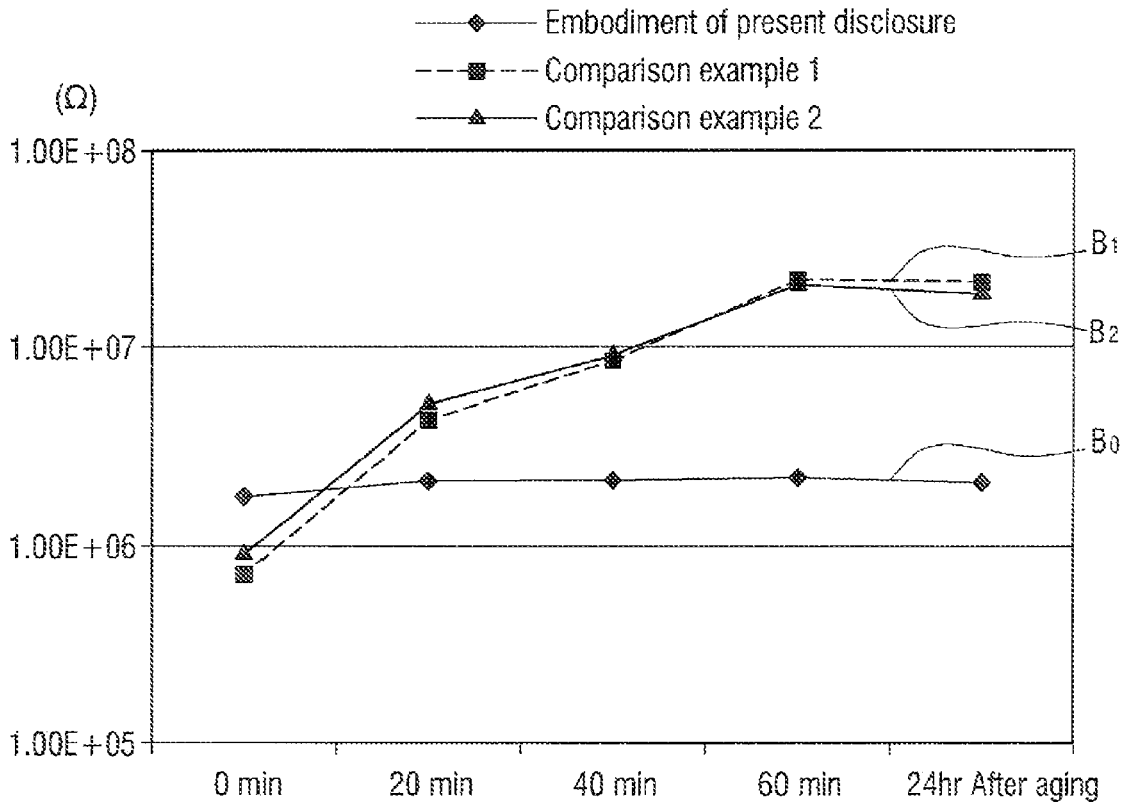
FIG. 6 is a graph illustrating data obtained from the second test.

The results of the second test are shown in Table 2 below, and are shown graphically in FIG. 6.

TABLE 2

| | Aging time of 0 min | Aging time of 20 min | Aging time of 40 min | Aging time of 60 min | Aging time of 24 hours |
|---|---|---|---|---|---|
| Toner supply roller 74 | 1.79E+06 Ω | 2.13E+06 Ω | 2.17E+06 Ω | 2.13E+06 Ω | 2.10E+06 Ω |
| Comparison example 1 (nylon 6 fibers) | 7.15E+05 Ω | 4.30E+06 Ω | 8.52E+06 Ω | 2.22E+07 Ω | 2.15E+07 Ω |
| Comparison example 2 (acrylic fibers) | 9.21E+05 Ω | 5.25E+06 Ω | 9.21E+06 Ω | 2.06E+07 Ω | 1.85E+07 Ω |

As illustrated in Table 2, the electrical resistance of the toner supply roller 74 does not substantially change over time. For comparison example 1 and comparison example 2, however, the electrical resistance of the toner supply rollers increases over time. This aspect is more clearly shown in FIG. 6. Referring to FIG. 6, graph $B_0$, which corresponds to the toner supply roller 74, is shown to be substantially horizontal and not changing significantly over time, whereas graphs $B_1$ and $B_2$, which correspond to comparison examples 1 and 2, respectively, show that the electric resistance of the comparison examples increases over time.

The toner supply roller 74 can exhibit a much lower change in the electrical resistance over a period of use than conventional toner supply rollers. These results show that the toner supply roller 74 can have a more stable conductivity over the period of use than conventional toner supply rollers.

In the third test, the toner supply roller 74 and the toner supply roller of comparison example 1 using the nylon 6 fibers can be mounted on the same image forming apparatus, and can be operated for continuous printing under condition HH for a period corresponding to their operating lifetimes to measure the color density of the resulting images and the amount of toner consumption.

Figure 7:
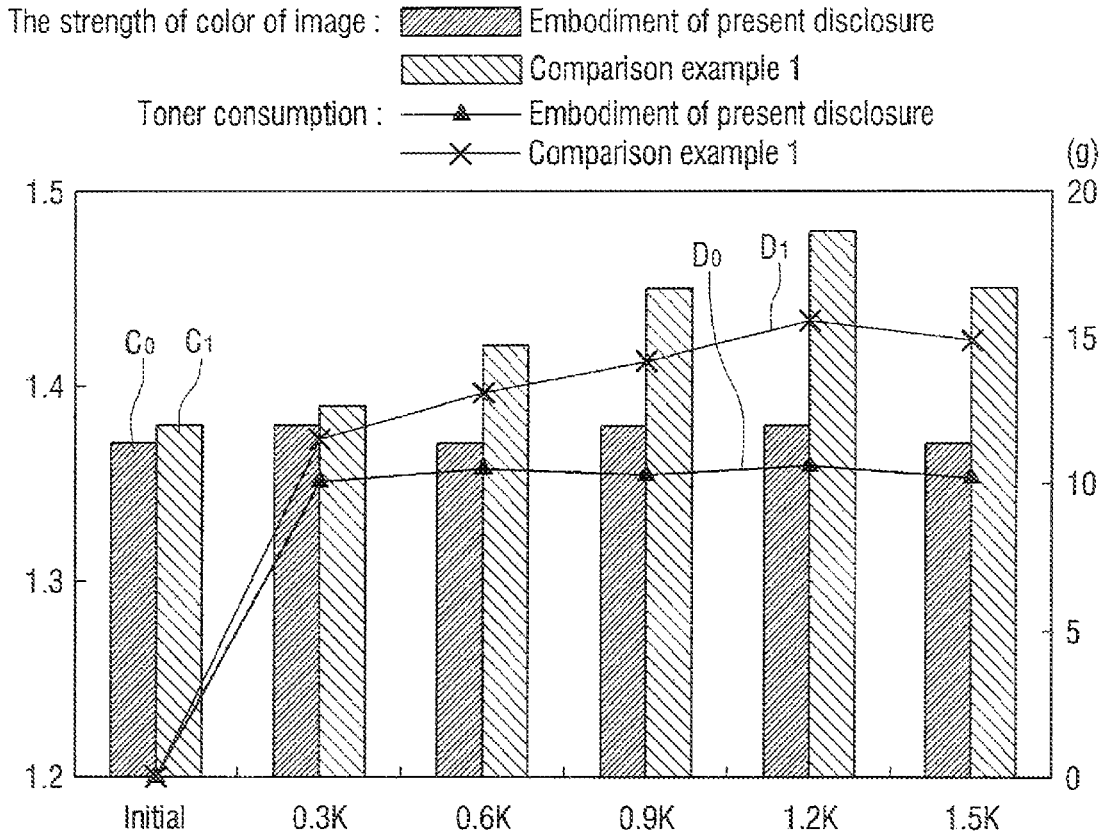
FIG. 7 is a graph illustrating data obtained from the third test.

The results of the third test are graphically shown in FIG. 7.

Examining the strength (e.g., density or intensity) of the color of the images with reference to FIG. 7, graph $C_0$ corresponding to the toner supply roller 74 shows that the strength of image color does not change significantly as the cumulative number of printed papers (e.g., 0.3K, 0.6K, 0.9K, 1.2K and 1.5K sheets as shown in FIG. 7) increases. For graph $C_1$, however, which corresponds to the toner supply roller of comparison example 1, the strength of the image color generally becomes higher as the number of printed papers increases.

Examining the toner consumption, graph $D_0$, which corresponds to the toner supply roller 74, shows that the amount of toner consumed does not significantly change as the number of printed papers increases. For graph $D_1$, however, which corresponds to the toner supply roller of comparison example 1, the amount of toner consumed generally becomes higher as the number of printed papers increases.

As described above, although the toner supply roller 74 can be exposed to condition HH for a long time, the strength of the image color and the toner consumption can be maintained substantially stable when compared with conventional toner supply rollers. This is because the electrical resistance of the toner supply roller 74 can be maintained substantially constant at the intended design value, less affected by the changes in the humidity and/or temperature.

A power supply unit (not shown) in the image forming apparatus can be configured to provide power to the toner supply roller 74. In general, direct current (DC) power or alternating current (AC) power can be supplied. To transport a toner to the developing roller 75 of the developing unit 70 using frictional charge and an electrical field, the amount (e.g., the absolute value) of the power supplied to the toner supply roller 74 can be smaller than the amount (e.g., the absolute value) of the power supplied to the developing roller 75.

A contact nip can be form between the toner supply roller 74 and the developing roller 75. According to an embodiment, the nip may be formed by the conductive fibers **74*b* making contact with the developing roller 75, without requiring the roller body 74*a* to contact the developing roller 75. As a result, it may be possible to rotate the toner supply roller 74 and the developing roller 75 at different rotational speeds. This difference in the respective rotational speeds, the toner particles between the fibers 74*b* can be thrown off, and can be prevented from being caught between the fibers 74*b***.

As can be appreciated from the above description, fibers of a toner supply roller can be made of nylon 12 fibers, and can be coated with a conductive polymer to provide a more stable electrical conductivity with respect to external conditions, such as, for example, the temperature or humidity, and over the period of use of the toner supply roller. As a result, a toner supply roller capable of maintaining a uniform strength of the color of the images and the toner consumption can be realized. In one or more embodiments of the present disclosure, a toner supply apparatus of a roller type can be used. In other embodiments, a toner supply apparatus of a belt type capable of rotation can also be used.

The several embodiments of the present disclosure may emphasize using nylon 12 fibers with the toner supply roller 74. Nylon 12 fibers, however, may be used with other rollers such as the discharging roller 51, the charging roller 73, and/or the cleaning roller 77, which can be manufactured using a conductive fiber roller to improve the conductivity. Moreover, even when the discharging apparatus, the charging apparatus, and the cleaning apparatus are not roller types but belt type apparatuses, or are fixed apparatuses, the use of conductive fibers can also be applicable for such belt type configurations.

While the disclosure has been shown and described with reference to several embodiments thereof, it will be understood by those skilled in the art that various changes in form and details may be made therein without departing from the spirit and scope of the disclosure as defined by the appended claims.

What is claimed is:

1. A toner supply apparatus for supplying toner in an image forming apparatus, comprising:

a body that is electrically conductive; and a plurality of fibers disposed on a surface of the body, the plurality of fibers including nylon 12 fibers containing a conductive material, wherein a moisture absorption rate of the plurality of fibers is below approximately 1.2 percent (%) at a relative humidity of 65%, and below approximately 1.5% at a relative humidity of 95%.

2. The toner supply apparatus according to claim 1, wherein surfaces of the plurality of fibers are coated with a conductive polymer.

3. The toner supply apparatus according to claim 2, wherein the conductive polymer is a compound having one of an aromatic heterocyclic structure and an aniline structure.

4. The toner supply apparatus according to claim 1, wherein a volume resistance of the plurality of fibers ranges from approximately $10^5$ ohms-per-centimeter (Ω/cm) to approximately $10^8$ Ω/cm.

5. The toner supply apparatus according to claim 1, wherein a density of the plurality of fibers ranges from approximately 18.5 items-per-millimeter (items/mm) to approximately 22.0 items/mm.

6. The toner supply apparatus according to claim 1, wherein a length of each of the plurality of fibers ranges from approximately 1.3 millimeters (mm) to approximately 1.7 mm.

7. The toner supply apparatus according to claim 1, wherein a diameter of each of the plurality of fibers ranges from approximately 25 micrometers (μm) to approximately 40 μm.

8. The toner supply apparatus according to claim 1, wherein the conductive material contained in the plurality of fibers comprises carbon black, and wherein a content of the carbon black in the plurality of fibers ranges from approximately 18 percent (%) to approximately 23%.

9. An image forming apparatus, comprising:

a developing unit configured to develop an electrostatic latent image using toner to form a visible toner image, the developing unit including a rotational member, the rotational member comprising:

a body that is electrically conductive; and a plurality of fibers disposed on a surface of the body, the plurality of fibers including nylon 12 fibers containing a conductive material, wherein a moisture absorption rate of the plurality of fibers is below approximately 1.2 percent (%) at a relative humidity of 65%, and below approximately 1.5% at a relative humidity of 95%.

10. The image forming apparatus according to claim 9, wherein surfaces of the plurality of fibers are coated with a conductive polymer.

11. The image forming apparatus according to claim 10, wherein the conductive polymer is a compound having one of an aromatic heterocyclic structure and an aniline structure.

12. The image forming apparatus according to claim 9, wherein a volume resistance of the plurality of fibers ranges from approximately $10^5$ ohms-per-centimeter (Ω/cm) to approximately $10^8$ Ω/cm.

13. The image forming apparatus according to claim 9, wherein a density of the plurality of fibers ranges from approximately 18.5 items-per-millimeter (items/mm) to approximately 22.0 items/mm.

14. The image forming apparatus according to claim 9, wherein a length of each of the plurality of fibers ranges from approximately 1.3 millimeters (mm) to approximately 1.7 mm.

15. The image forming apparatus according to claim 9, wherein a diameter of each of the plurality of fibers ranges from approximately 25 micrometers (μm) to approximately 40 μm.

16. The image forming apparatus according to claim 9, wherein the conductive material contained in the plurality of fibers comprises carbon black, and wherein a content of the carbon black in the plurality of fibers ranges from approximately 18 percent (%) to approximately 23%.

17. The image forming apparatus according to claim 9, wherein the rotational member comprises a device selected from among a charging device configured to charge an image bearing body on surface of which the electrostatic latent image is formed, a cleaning device configured to remove foreign substances from a surface of the charging device and a discharging device configured to remove an electrical charge from a printing medium.

18. A developing unit usable in an image forming apparatus to form a toner image, comprising:

a conductive member that comprises:

a body that is electrically conductive; and a plurality of fibers disposed on a surface of the body, the plurality of fibers including nylon 12 fibers containing a conductive material, wherein a moisture absorption rate of the plurality of fibers is below approximately 1.2 percent (%) at a relative humidity of 65%, and below approximately 1.5% at a relative humidity of 95%.

19. The developing unit according to claim 18, wherein the conductive member comprises a device selected from among a charging device configured to charge an image bearing body configured to canyon a surface thereof an electrostatic latent image, a cleaning device configured to remove foreign substances from the charging device and a discharging device configured to remove an electrical charge from a printing medium.

20. The developing unit according to claim 18, wherein surfaces of the plurality of fibers are coated with a conductive polymer having one of an aromatic heterocyclic structure and an aniline structure, and wherein the conductive material contained in the plurality of fibers comprises carbon black, a content of which in the plurality of fibers ranging from approximately 18 percent (%) to approximately 23%.

21. The developing unit according to claim 18, wherein a volume resistance of the plurality of fibers ranges from approximately $10^5$ ohms-per-centimeter (Ω/cm) to approximately $10^8$ Ω/cm.

22. The developing unit according to claim 18, wherein the body is made of a conductive metal in a substantially cylindrical shape, the conductive material comprising aluminum.

23. The developing unit according to claim 18, wherein the conductive member is configured to rotate in contact with a rotational body, respective rotational speeds of the conductive member and the rotational body being different from each other.

* * * * *